US007562961B2

(12) United States Patent
Inoue

(10) Patent No.: US 7,562,961 B2
(45) Date of Patent: Jul. 21, 2009

(54) DROPLET DISCHARGING APPARATUS, IMAGE FORMING APPARATUS AND PRELIMINARY DISCHARGE METHOD

(75) Inventor: Hiroshi Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 386 days.

(21) Appl. No.: 10/946,096

(22) Filed: Sep. 22, 2004

(65) Prior Publication Data

US 2005/0078145 A1 Apr. 14, 2005

(30) Foreign Application Priority Data

Sep. 22, 2003 (JP) ..... 2003-330319

(51) Int. Cl.
*B41J 2/165* (2006.01)
*B41J 2/01* (2006.01)

(52) U.S. Cl. ..... 347/35; 347/104

(58) Field of Classification Search ..... 347/31, 347/35, 42, 101, 29, 33, 104
See application file for complete search history.

(56) References Cited

U.S. PATENT DOCUMENTS

| | | | | |
|---|---|---|---|---|
| 6,198,494 | B1 * | 3/2001 | Haraguchi et al. | 347/232 |
| 6,350,009 | B1 * | 2/2002 | Freund et al. | 347/35 |
| 6,672,705 | B2 * | 1/2004 | Kitahara et al. | 347/42 |
| 7,040,734 | B2 * | 5/2006 | Nakashima et al. | 347/33 |

FOREIGN PATENT DOCUMENTS

| | | | |
|---|---|---|---|
| JP | 04-187449 | * | 7/1992 |
| JP | 09-109377 | A | 4/1997 |
| JP | 2000-127362 | A | 5/2000 |
| JP | 2000-263801 | A | 9/2000 |
| JP | 2000-272770 | A | 10/2000 |
| JP | 2001-105628 | A | 4/2001 |
| JP | 2002-103598 | A | 4/2002 |
| JP | 2002-211060 | A | 7/2002 |
| JP | 2002-356026 | A | 12/2002 |

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

The droplet discharging apparatus includes: a discharging head which has discharge holes for discharging liquid droplets; a conveyance device which conveys at least one of the discharging head and discharge receiving media in a direction substantially orthogonal to a width direction of the discharge receiving media to cause the discharging head and the discharge receiving media to move relative to each other; a belt which holds the discharge receiving media in a discharge region opposing a face of the discharging head whereon the discharge holes are formed, the belt having a purge region comprising an absorbing member which receives and absorbs the liquid droplets discharged from the discharging head during preliminary discharge; and a positional alignment device which aligns a position of the purge region in such a manner that the purge region is positioned between the discharge receiving media.

16 Claims, 8 Drawing Sheets

DROPLET DISCHARGING APPARATUS, IMAGE FORMING APPARATUS AND PRELIMINARY DISCHARGE METHOD

This Non-provisional application claims priority under 35 U.S.C. § 119(a) on Patent Application No(s). 2003-330319 filed in Japan on Sep. 22, 2003, the entire contents of which are hereby incorporated by reference.

BACKGROUND OF THE INVENTION

1. Field of the Invention

The present invention relates to a droplet discharging apparatus, an image forming apparatus, and a preliminary discharge method, and more particularly, to preliminary discharge technology for droplets discharged from a discharging head.

2. Description of the Related Art

In recent years, inkjet recording apparatuses (inkjet printers) serving as recording apparatuses that print/record images or the like taken by digital still camera have become widely distributed. Inkjet recording apparatuses have a plurality of recording elements (nozzles) in the head, the recording head is moved to scan the recording medium while ink droplets are discharged from the recording elements to the recording medium, the recording medium is conveyed by a single line when one line of image has been recorded on recording paper, and an image is formed on the recording paper by repeating these steps.

There are inkjet printers that use a short serial head and record images while causing the head to scan in the width direction of the recording medium, or those that use a line head in which recording elements are arrayed across the entire range of one side of the recording medium. In printers in which a line head is used, images can be recorded on the entire surface of the recording medium by scanning the recording medium in the direction orthogonal to the array direction of the recording elements. In printers in which a line head is used, a carriage or another conveyance system for moving the short head back and forth is unnecessary, and complex scanning control for the carriage movement and recording medium is not required. Also, the recording medium alone moves, so recording speed can be increased in comparison with printers in which a serial head is used.

In an inkjet printer, for a reason of some kind, discharge errors may arise in a portion of the plurality of recording elements, for instance, ink may fail to be discharged, or the amount of ink discharged (the dot size formed by the droplet deposited on the recording medium) or the direction of flight thereof (the deposited position of the droplet) may be defective, or the like. The presence of defective recording elements of these kinds may cause the quality of the recorded image to be degraded, and hence it requires countermeasures.

Conventionally, discharge errors in the recording elements are prevented by removing thickened ink that has formed in the vicinity of the discharge ports, by performing preliminary discharge (purging), such as a dummy discharge, liquid discharge, or the like, at periodic intervals. Moreover, a method is also known whereby, if a discharge error is detected, then maintenance of the recording elements is carried out by means of the aforementioned purging operation, or by printing a test pattern, or the like. In general, in a purging operation, ink is discharged onto a maintenance member, such as a cap, but ink can be discharged onto the conveyance belt instead.

However, in the method for purging onto a conveyance belt, it is necessary to clean the conveyance belt satisfactorily after purging. If a cleaning method based on wiping the conveyance belt in one direction is adopted, then a problem may arise in that the dirt cannot be removed sufficiently. If the conveyance belt is used without having been cleaned satisfactorily, then this may cause degradation of the print quality in the printing results, such as transfer onto the rear side of the paper, or the like.

Japanese Patent Application Publication No. 2000-272770 discloses a sheet conveyance apparatus and image forming apparatus including a mechanism whereby the preliminary discharge position can be set in a variable manner, in accordance with the position of the paper. However, in Japanese Patent Application Publication No. 2000-272770, there is no disclosure regarding maintenance operations, such as preliminary discharge, or the like.

Japanese Patent Application Publication No. 2000-127362 discloses an inkjet recording apparatus comprising a head and a plurality of cleaning members, the conveyance belt being cleaned on the downstream side of the head. However, in the inkjet recording apparatus described in Japanese Patent Application Publication No. 2000-127362, cleaning devices are provided in equal number to the recording heads, and therefore the recording head and the cleaning devices become large in size, and control of the cleaning device and conveyance device becomes complicated.

Japanese Patent Application Publication No. 2001-105628 discloses an image forming apparatus comprising an ink receptacle body which is attachable to and detachable from the conveyance belt, and preliminary discharge is carried out into the ink receptacle body. However, in the image forming apparatus described in Japanese Patent Application Publication No. 2001-105628, there is a large opening in the conveyance belt, and hence the suction force required in order to prevent lifting up of the paper cannot be obtained.

Japanese Patent Application Publication No; 2002-103598 discloses a printer comprising a restoring region for restoring the discharging function of the printer head, situated over a conveyance belt having an opening therein, and a restoring operation of the printer head is executed in the restoring region. However, the printer described in Japanese Patent Application Publication No. 2002-103598 has a holder for holding the ink receptacle body over the conveyance belt, and therefore it is necessary to withdraw the printer head.

SUMMARY OF THE INVENTION

The present invention has been contrived in view of such circumstances, and an object thereof is to provide a droplet discharging apparatus, an image forming apparatus and a preliminary discharge method whereby droplets discharged onto a belt for holding a discharge receiving medium can be removed in a reliable manner.

In order to attain the above-described object, the present invention is directed to a droplet discharging apparatus, comprising: a discharging head which has discharge holes for discharging liquid droplets; a conveyance device which conveys at least one of the discharging head and discharge receiving media in a direction substantially orthogonal to a width direction of the discharge receiving media to cause the discharging head and the discharge receiving media to move relative to each other; a belt which holds the discharge receiving media in a discharge region opposing a face of the discharging head whereon the discharge holes are formed, the belt having a purge region comprising an absorbing member which receives and absorbs the liquid droplets discharged from the discharging head during preliminary discharge; and a positional alignment device which aligns a position of the purge region in such a manner that the purge region is positioned between the discharge receiving media.

According to the present invention, a purge region composed of an absorbing member for absorbing liquid droplets is provided on the belt, and the position of the purge region (the phase of the belt) is aligned in such a manner that the purge region is positioned between discharge receiving media (between paper sheets). Therefore, a preliminary discharge (purge) can be performed onto the purge region. Even during continuous discharge, it is possible to carry out purge between the discharge receiving media, thereby helping to improve productivity.

Moreover, the purge region forms a droplet receptacle during preliminary discharge, and hence there is not wasted consumption of the discharge receiving media for the purpose of purging. Furthermore, since the purge region is constituted by an absorbing member for absorbing droplets, it is possible to prevent soiling of other portions of the belt.

The discharging head may be a discharging head wherein liquid discharge holes (nozzle openings) are disposed across the entire area of the region in which droplets can be discharged in a direction substantially orthogonal to the direction of conveyance of the discharge receiving media, or it may be a discharging head wherein droplets are discharged by moving a discharging head of short dimensions in a direction substantially orthogonal to the direction of conveyance of the discharge receiving media.

The discharge receiving media include various media called "record receiving media", "recording media", or simply "media", and are media onto which droplets of ink, a chemical, a processing liquid, or the like, are discharged by means of the discharging head. The discharge receiving media include media of various types, irrespective of material or size, such as paper, resin sheets, such as OHP sheets, or the like, film, cloth, or other materials.

The conveyance device may cause the discharge receiving media to move with respect to a fixed discharging head, or it may cause the discharging head to move with respect to a fixed discharge receiving media.

Preliminary discharge (purging) includes discharge carried out with the purpose of maintenance of the discharge holes, such as a mode where periodic dummy discharges (liquid discharges) are carried out in order to prevent discharge errors, or a mode where dummy discharge is carried out when discharge errors are detected, or the like.

Preferably, positional alignment (phase alignment) is carried out by the positional alignment device, in such a manner that at the front end or the trailing end of the discharge receiving medium is not positioned over the purge region.

The absorbing member includes members wherein, when droplets are deposited on the absorbing member, the droplets permeate inside the member, in a prescribed period of time, and it may be constituted by a single material, or it may be constituted by a plurality of materials. Furthermore, the absorbing member is preferably made of a material which does not expand. Moreover, the absorbing member is preferably made of a material which can be used repeatedly, and the absorbing member is preferably made of a material whereby the liquid absorbed therein can be recovered and the absorbing member can be reused. It is possible to use a porous member, non-woven cloth, or the like, for the absorbing member.

The purge region may be provided at prescribed intervals on an endless belt.

The purge region and the conveyance belt should be connected in such a manner that step difference between the purge region and the belt is prevented as far as possible.

It is important from the viewpoint of ensuring the quality of the discharging results that a uniform interval is maintained between the belt (discharge receiving medium) and the face of the discharging head that opposes the discharge receiving medium, and therefore, preferably, the discharge receiving medium holding face (conveyance face) of the belt is maintained in a flat state.

The positional alignment device includes purge region detecting devices for detecting the purge region on the belt, discharge receiving medium detecting devices for detecting the position of the discharge receiving medium, speed detecting devices for detecting the speed of the belt, and the like.

Preferably, the absorbing member for absorbing the droplets composes a supporting body of the belt.

According to the present invention, since the supporting body of the belt is made from an absorbing member, it is possible to simplify the structure of the belt. For example, in the purge region, the belt supporting body (core member) is used directly (in an exposed state), and in the regions other than the purge region, a suitable coating is formed onto the surface of the belt supporting body, or a member made from another material is bonded onto same.

The belt is required to have a prescribed strength and expansivity characteristics (resistance to expansion), and it may be reinforced by means of metal, resin, or the like.

Preferably, the belt has a plurality of the purge regions, and the plurality of purge regions are disposed at intervals corresponding to a most frequently used size of the discharge receiving medium.

According to the present invention, it is possible to reduce the interval between discharge receiving media, and hence productivity is increased. Furthermore, since a large conveyance region can be taken for the discharge receiving medium, the conveyance characteristics of large-size discharge receiving media are improved.

The interval at which purge regions are disposed may be aligned with the most frequently used size of discharge receiving medium, or it may be aligned with the lowest common multiple of the most commonly used size of discharge receiving medium and the second most commonly used size of discharge receiving medium. Furthermore, it is also possible to dispose a plurality of discharge receiving media within the interval between the positions of the purge regions. Moreover, not all of the intervals between the positions of the purge regions need to be the same, and a plurality of different intervals between the positions of the purge regions may also be adopted.

The mode for connecting a purge region to the regions other than the purge region may be one wherein the purge region member is fitted into the discharge receiving medium holding surface of the belt.

Preferably, a clearance between a face of the purge region opposing the face of the discharging head whereon the discharge holes are formed, and the face of the discharging head is within a clearance range between a discharge receiving medium holding face of the belt and the face of the discharging head.

According to the present invention, by ensuring that the clearance between the face of the purge region opposing the discharging head, and the face of the discharging head on which the discharge holes are formed, is within the clearance of the discharging head with respect to the belt in the discharge receiving medium conveyance region, then it is possible to prevent interference between the purge region and the face of the discharging head whereon the discharge holes are formed.

More particularly, if the purge region swells up due to the droplets it has absorbed, then the distance between the purge region and the discharging head will decrease, and even in cases such as this, it is necessary to maintain a distance from the face of the discharging head whereon the discharge holes are formed. Detecting devices for detecting the thickness of the purge region when it has swelled, or the distance between the purge region and the discharging head, may also be provided.

Preferably, the droplet discharging apparatus further comprises a purge region cleaning device which cleans the purge region.

According to the present invention, a composition is adopted whereby a purge region that has absorbed ink droplets, or the like, is cleaned by a purge region cleaning device, and hence maintenance, such as replacement, or the like, of the purge regions is not required.

Cleaning involves, for instance, suction removal for removing droplets from the purge region, or brushing removal for brushing away dirt or adhering material from the surface, or the like. The suctioning device used in suction removal may be a member having even higher absorption characteristics than the absorbing member used in the purge region, or it may be a pump, or the like, which performs suction in a forcible manner. Furthermore, it is also possible to dry the purge region.

Preferably, the droplet discharging apparatus further comprises: a maintenance member; and a discharge control device which performs control in such a manner that preliminary discharge is carried out onto the maintenance member during a non-discharging period.

According to the present invention, since control is performed in such a manner that purging is performed onto the maintenance member during the non-discharging period, then the load on the member used for the purge region and the purge region cleaning device can be reduced, and the lifespan of these members can be increased.

The non-discharging period includes the intervals (idle times) where no discharging data has been sent, the time from switching the power supply on until the start of the first discharging operation, and the like. The non-discharging period may include a period where no discharge onto the discharge receiving media according to discharging data is performed. In a case of an image forming (recording) apparatus such as an inkjet recording apparatus, the non-discharging period includes the time from switching the power supply on until the start of the first printing operation, and the intervals after finishing printing of a particular image and before printing a subsequent, different image, and the like. The non-discharging period may include a period where no printing onto the recording media according to print data is performed.

A cap may be used as the maintenance member, or another member may be used for same.

It is also possible to include control for carrying out purging in the purge region during a discharging period, in the discharge control performed by the purge control device.

Preferably, the droplet discharging apparatus further comprises: a discharge mode switching device which switches discharge modes; and a judging unit which judges whether or not to position the recording medium on the purge region in accordance with the discharge mode, wherein the positional alignment device aligns the position of the purge region in accordance with a judgment result by the judging unit.

According to the present invention, since the position of the purge region (phase of the belt) is controlled in such a manner that the discharge receiving medium is not conveyed on a purge region, then it is possible to suction the discharge receiving medium in a reliable manner.

Moreover, in order to attain the above-described object, the present invention is also directed to an image forming apparatus, comprising: a recording head which has discharge holes for discharging ink droplets; a conveyance device which conveys at least one of the recording head and recording media in a direction substantially orthogonal to a width direction of the recording media to cause the recording head and the recording media to move relative to each other; a belt which holds the recording media in a recording region opposing a face of the recording head whereon the discharge holes are formed, the belt having a purge region comprising an absorbing member which receives and absorbs the ink droplets discharged from the recording head during preliminary discharge; and a positional alignment device which aligns a position of the purge region in such a manner that the purge region is positioned between the recording media.

According to the present invention, a purge region composed of an absorbing member for absorbing ink droplets is provided on the belt, and the position of the purge region (the phase of the belt) is aligned in such a manner that the purge region is positioned between recording media. Therefore, preliminary discharge can be carried out onto the purge region, and even in the case of continuous printing, purging can be performed between recording media, thereby helping to improve productivity.

Moreover, since the purge region is constituted by an absorbing member which absorbs droplets, it is possible to prevent soiling of other portions of the belt.

The recording head may be a full line type recording head wherein ink discharge holes (nozzle openings) are disposed across the entire printable region in a direction substantially orthogonal to the direction of conveyance of the recording medium, or it may be a shuttle scan type recording head wherein ink droplets are discharged by moving a discharging head of short dimensions in a direction substantially orthogonal to the direction of conveyance of the recording medium.

Moreover, "recording medium" indicates a medium which receives printing by means of a recording head (an image forming medium), and this term includes various types of media, irrespective of material and size, such as continuous paper, cut paper, sealed paper, resin sheets, such as OHP sheets, film, cloth, and other materials. The recording medium may further include the above-described "discharge receiving medium".

In the present specification, the term "printing" indicates the concept of forming images in a broad sense, including text, and not simply the formation of text.

Preferably, the purge region is also used as a surplus ink receiving region in a case of marginless printing.

According to the present invention, by using the purge region also as the surplus ink receiving region in the case of marginless printing (full surface printing) (namely, by forming same as common regions), it is possible to simplify the structure of the conveyance belt.

The surplus ink receiving region in the case of borderless printing may be constituted in such a manner that it surrounds the recording medium. By adopting a composition of this kind, there is no transfer of ink onto the rear face of the paper in the case of borderless printing.

Furthermore, the present invention also provides a method for achieving the aforementioned object. More specifically, the present invention is also directed to a preliminary discharge method for a droplet discharging apparatus comprising: a discharging head which has discharge holes for discharging liquid droplets; a conveyance device which conveys at least one of the discharging head and discharge receiving media in a direction substantially orthogonal to a width direction of the discharge receiving media to cause the discharging head and the discharge receiving media to move relative to each other; a belt which holds the discharge receiving media in a discharge region opposing a face of the discharging head whereon the discharge holes are formed, the belt having a purge region comprising an absorbing member which receives and absorbs the liquid droplets discharged from the discharging head during preliminary discharge, the method comprising: a moving step of causing the discharging head and the discharge receiving media to move relative to each other; a purge region detecting step of detecting the purge region provided on the belt holding the discharge receiving media; a preliminary discharge step of performing a preliminary discharge onto the purge region, when the purge region is detected by the purge region detecting step; and an absorbing step of causing the absorbing member of the purge region to absorb the liquid droplets discharged from the discharging head.

In the purge region detecting step, a discharge receiving medium detecting step of detecting the discharge receiving medium by means of a sensor, or the like, may also be provided, control being performed in such a manner that preliminary discharge is carried out if the purge region is detected and the discharge receiving medium is not detected.

Furthermore, a cleaning step is preferably provided for cleaning the purge region soiled as a result of the preliminary discharge step.

According to the present invention, a purge region formed from an absorbing member capable of absorbing droplets is provided on a belt for holding a discharge receiving medium, and the position of the purge region (the phase of the belt) is aligned in such a manner that the purge region comes between discharge receiving media. Since the droplets can be discharged onto the purge region during a purge discharge of droplets, it is possible to increase productivity, whilst also eliminating waste of the discharge receiving medium for the purpose of purging.

Moreover, if the belt supporting body is constituted by the absorbing member, then it is possible to use the supporting body as a purge region, and hence the structure of the belt can be simplified.

By adjusting the interval between purge regions to the most frequently used size of discharge receiving medium, increased productivity can be envisaged and the conveyance performance of the discharge receiving medium can be improved.

Preferably, a prescribed clearance is provided between the purge region and the discharging head, even in the case of swelling due to absorption of droplets.

Furthermore, a purge region cleaning device for cleaning the purge region is preferably provided.

If control is performed in such a manner that purging is carried out onto a maintenance member such as a cap or the like, when recording is not being performed, then it is possible to reduce the wear of the member forming the purge region, and the purge region cleaning member.

In an image forming apparatus having a recording head for discharging ink onto a recording medium, by providing a purge region made of an absorbing member on the belt which holds the recording medium in the print region, it is possible to carry out purging in-between recording media, even during continuous printing. Furthermore, by combining use of the purge region and the surplus ink receiving region for borderless printing, it is possible to use the area of the conveyance belt in a highly efficient manner.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
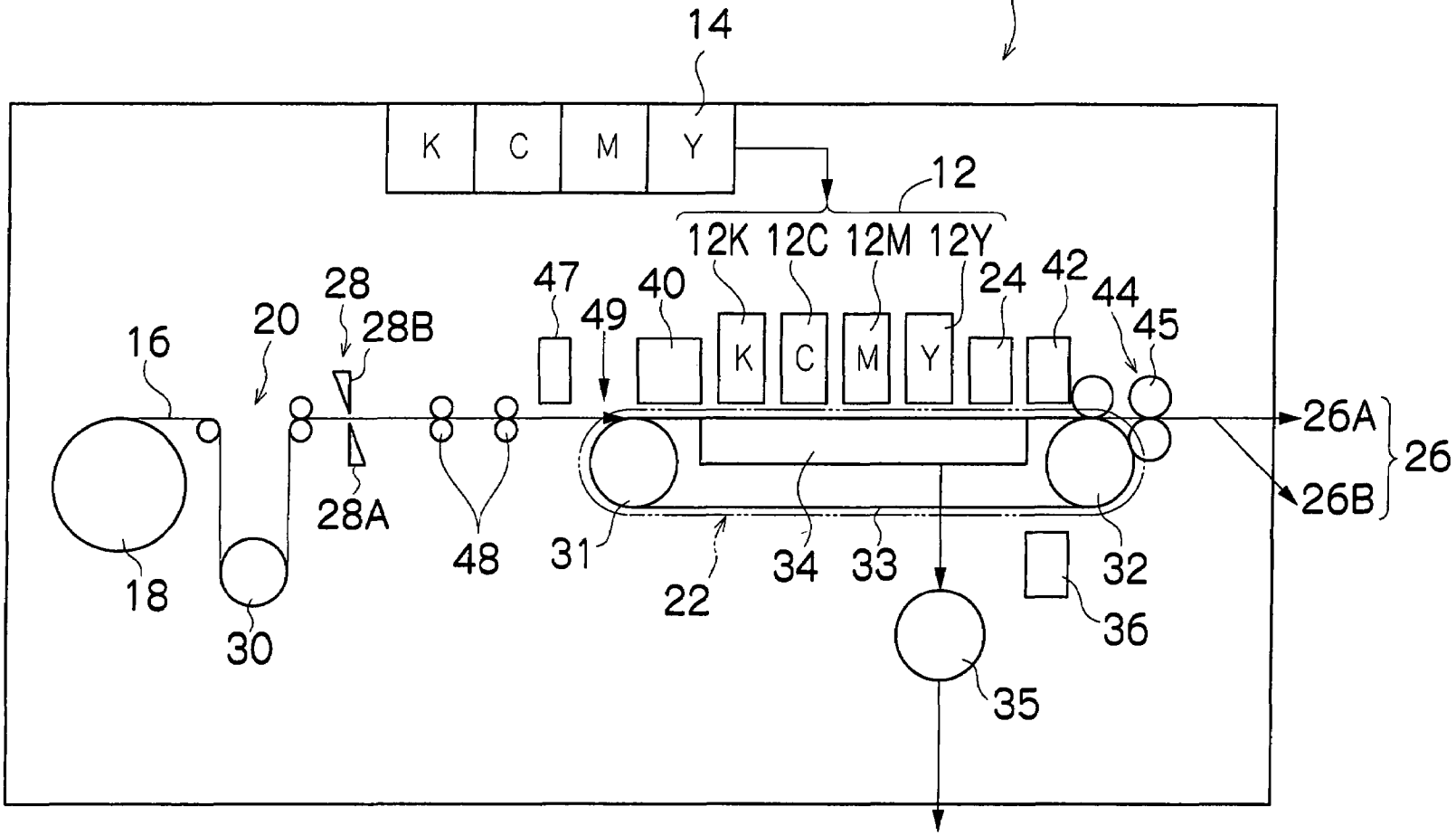
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a line CCD sensor 21 for determining the shape, orientation, and position of the recording paper 16; a suction belt conveyance unit 22 disposed facing the nozzle face (ink-droplet discharge face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for roll paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for roll paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet discharge is controlled so that the ink-droplets are discharged in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction. Instead of the air suction conveyance as in the present embodiment, the belt 33 can be provided with another attraction conveyance with electrostatic attraction, or the like.

Purge regions 100 and paper attraction regions 105 (not shown in FIG. 1, but shown in FIG. 6) are arranged on the face of the belt 33 on which the recording paper is held. The purge regions 100 can receive ink droplets during purging, and the paper attraction regions 105 can hold the recording paper 16 by attraction.

The belt 33 is driven in the clockwise direction in FIG. 1 by the motive force of a motor 88 (not shown in FIG. 1, but shown in FIG. 5) being transmitted to at least one of the rollers 31 and 32, which the belt 33 is set around, and the recording paper 16 held on the belt 33 is conveyed from left to right in FIG. 1. The belt 33 is described in detail later.

Since ink adheres to a surplus ink receiving region 140 (not shown in FIG. 1, but shown in FIG. 11) arranged on the belt 33 when printing a full surface (marginless) image, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
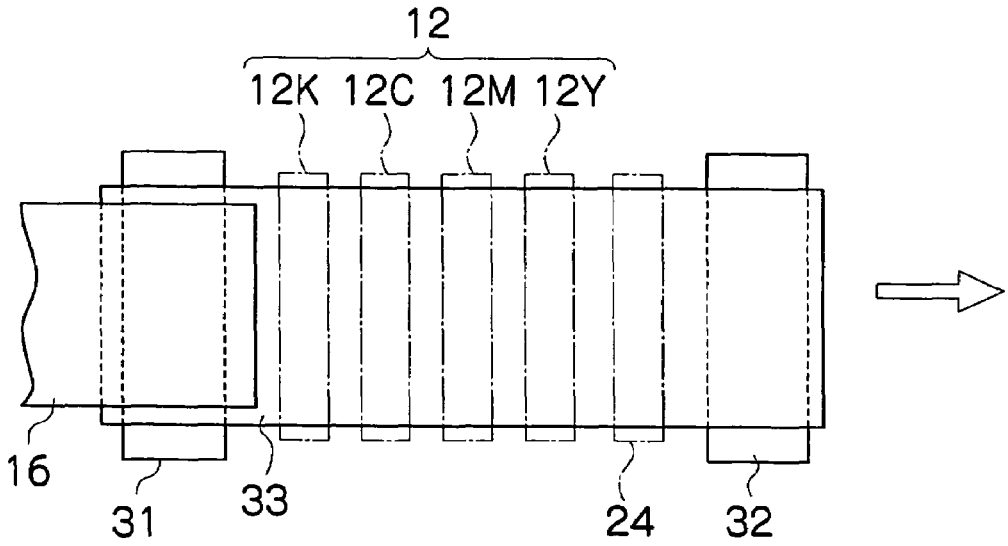
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. As shown in FIG. 2, each of the print heads 12K, 12C, 12M, and 12Y is composed of a line head, in which a-plurality of ink-droplet discharge holes (nozzles) are arranged along a length that exceeds at least one side of the maximum-size recording paper 16 intended for use in the inkjet recording apparatus 10, and a specific structural example is described later.

The print heads 12K, 12C, 12M, and 12Y are arranged in this order from the upstream side along the paper conveyance direction. A color print can be formed on the recording paper 16 by discharging the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for discharging light-colored inks such as light cyan and light magenta are added.

Although the configuration is described in the present embodiment where the recording paper 16 suctioned on the belt 33 is moved, another configuration is also possible where a recording head is moved above a fixed recording paper 16.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for discharge defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet discharge width (image recording width) of the print heads 12K, 12C, 12M, and 12Y, as shown in FIG. 2. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed-of photoelectric transducing elements which are arranged two-dimensionally.

The print determination unit 24 reads a test pattern printed with the print heads 12K, 12C, 12M, and 12Y for the respective colors, and the discharge of each head is determined. The discharge determination includes the presence of the discharge, measurement of the dot size, and measurement of the dot deposition position. Also, the print determination unit 24 is provided with a light source (not shown) for directing light to dots formed by deposited droplets.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively.

Although not shown in FIG. 1, a sorter for collecting prints according to print orders is provided to the paper output unit 26A for the target prints. The paper output unit 26B is for the printed matter with the test print.

A recording paper detection unit 47 for detecting the presence of the recording paper 16 is disposed before the suction belt conveyance unit 22. The recording paper detection unit 47 is composed of a light emitting part and a light receiving part. When the light emitted from the light emitting part is blocked by the recording paper 16 and does not enter the light receiving part, it is determined that there is the recording paper 16 in a detection region of the recording paper detection unit 47. Alternatively, the recording paper detection unit 47 may have a reflection-type construction, in which it is determined that there is the recording paper 16 in the detection region when the light emitted from the light emitting part is reflected by the recording paper 16 and enters the light receiving part. Alternatively, the recording paper detection unit 47 may have the same construction with the print determination unit 24.

The recording paper 16 supplied from the paper supply unit 18 is conveyed to the detection region of the recording paper detection unit 47 through pairs of the conveyance rollers 48. One of the pairs of the conveyance rollers 48 arranged at the upstream side and the downstream side along the conveyance direction functions as the pair of driving rollers, and the other functions as the pair of driven rollers. After the recording paper 16 passed through the detection region of the recording paper detection unit 47, the recording paper 16 is stopped at a standby position 49 set just before the suction belt conveyance unit 22.

The position of the recording paper 16 is thus aligned before the recording paper is conveyed by the suction belt conveyance unit 22.

Moreover, although not shown in FIG. 1, paper detection devices, such as sensors, or the like, for detecting whether or not recording paper 16 is present are provided appropriately in the region through which the recording paper 16 is conveyed. Examples of such sensors include: paper sensors for detecting whether or not recording paper 16 is present in the printing region, skew sensors for detecting the skew (deviation in the conveyance direction of the recording paper 16) on the paper conveyance path, and sensors for detecting the recording paper 16 immediately before the respective processing units. In addition to paper detection devices, various other types of sensors (detection devices) are also provided, such as a purge region detection unit 102 (not shown in FIG. 1, but shown in FIGS. 5 and 6) for detecting the purge region on the belt 33, temperature sensors in the processing unit performing heat treatment, and the like.

Next, the structure of the print heads is described. The print heads 12K, 12C, 12M, and 12Y provided for the ink colors have the same structure, and a reference numeral 50 (shown in FIG. 4) is hereinafter designated to any of the print heads 12K, 12C, 12M, and 12Y.

Figure 3:
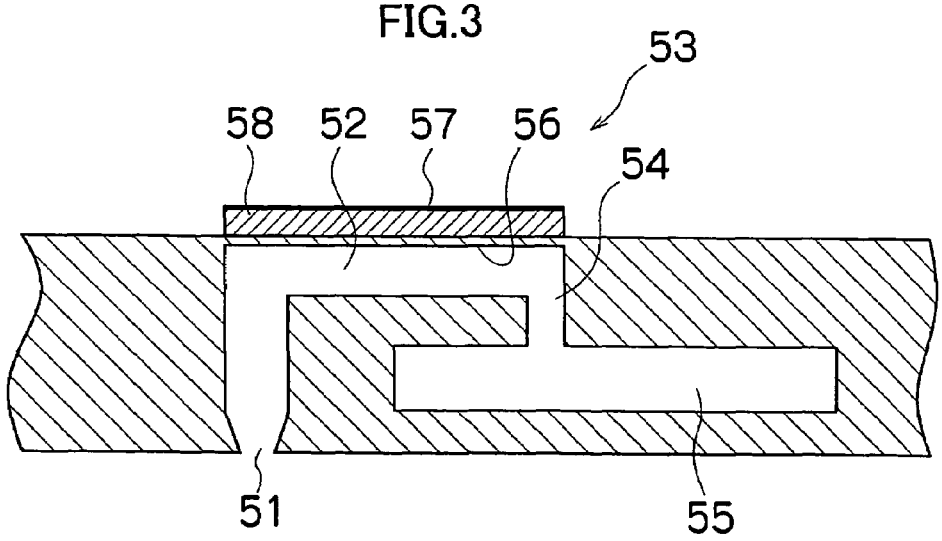
FIG. 3 is a sectional view showing an example of the inner structure of an ink chamber unit in a print head in the inkjet recording apparatus.

FIG. 3 is a cross-sectional view showing the inner structure of an ink chamber unit 53. The print head 50 is provided with a plurality of ink discharge holes (nozzle holes) 51. In order to maximize the density of the dots printed on the surface of the recording paper, the intervals of the ink discharge holes arranged in the print head (nozzle pitch) should be minimized. As shown in FIG. 3, the print head 50 in the present embodiment has a structure in which a plurality of ink chamber units 53 including nozzles 51 for discharging ink-droplets and pressure chambers 52 connecting to the nozzles 51 are disposed in the form of a staggered matrix, and the effective nozzle pitch is thereby made small.

The planar shape of the pressure chamber 52 provided for each nozzle 51 is substantially a square, and the nozzle 51 and an inlet of supplied ink (supply port) 54 are disposed in both corners on a diagonal line of the square. Each pressure chamber 52 is connected to a common channel 55 through the supply port 54.

An actuator 58 having a discrete electrode 57 is joined to a pressure plate 56, which forms the ceiling of the pressure chamber 52, and the actuator 58 is deformed by applying drive voltage to the discrete electrode 57 to discharge ink from the nozzle 51. When ink is discharged, new ink is delivered from the common flow channel 55 through the supply port 54 to the pressure chamber 52.

In the implementation of the present invention, the arrangement structure of the nozzle 51 is not particularly limited to the above-described embodiment. Moreover, the present embodiment adopts the structure that ejects ink-droplets by deforming the actuator 58 such as a piezoelectric element; however, the implementation of the present invention is not particularly limited to this. Instead of the piezoelectric inkjet method, various methods may be adopted including a thermal inkjet method in which ink is heated by a heater or another heat source to generate bubbles, and ink-droplets are ejected by the pressure thereof.

Figure 4:
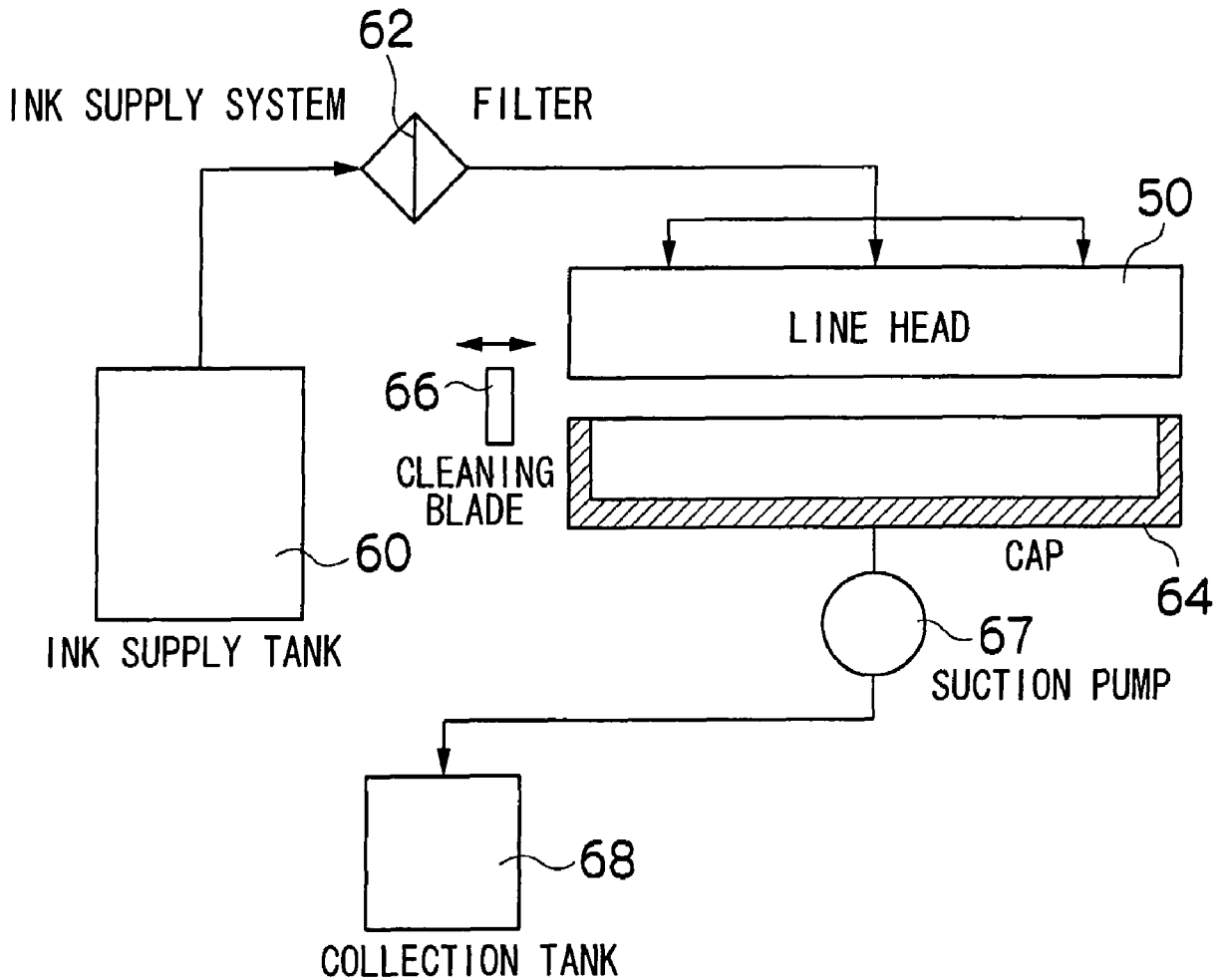
FIG. 4 is a schematic drawing showing a configuration of an ink supply system in the inkjet recording apparatus.

FIG. 4 is a schematic drawing showing the configuration of the ink supply system in the inkjet recording apparatus 1O.

An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform discharge control in accordance with the ink type.

A filter 62 for removing foreign matters and bubbles is disposed between the ink supply tank 60 and the print head 50, as shown in FIG. 4. The filter mesh size in the filter 62 is preferably equivalent to or less than the diameter of the nozzle and commonly about 20 μm.

Although not shown in FIG. 4, it is preferable to provide a sub-tank integrally to the print head 50 or nearby the print head 50. The sub-tank has a damper function for preventing variation in the internal pressure of the head and a function for improving refilling of the print head.

Aspects in which the internal pressure is controlled by the sub-tank include aspects in which the internal pressure inside the ink chamber unit 53 is controlled by the difference in ink levels between the sub-tank open to the atmosphere and the ink chamber unit 53 inside the head 51; aspects in which the internal pressures of the sub-tank and ink chamber are controlled by a pump connected to a sealed sub-tank; and the like, and any of these aspects may be used.

The inkjet recording apparatus 10 is also provided with a cap 64 as a device to prevent the nozzle 51 from drying out or to prevent an increase in the ink viscosity in the vicinity of the nozzle 51, and a cleaning blade 66 to clean the nozzle face.

A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

During printing or standby, when the frequency of use of specific nozzles 51 is reduced and ink viscosity increases in the vicinity of the nozzle, a preliminary discharge (dummy discharge, liquid discharge) is made toward the cap 64 to discharge the degraded ink.

Also, when bubbles have become intermixed in the ink inside the print head 50 (inside the pressure chamber 52), the cap 64 is placed on the print head 50, ink (ink in which bubbles have become intermixed) inside the pressure chamber 52 is removed by suction with a suction pump 67, and the suction-removed ink is sent to an ink recovery tank 68. This suction action entails the suctioning of degraded ink whose viscosity has increased (hardened) when initially loaded into the head, or when service has started after a long period of being stopped.

Figure 5:
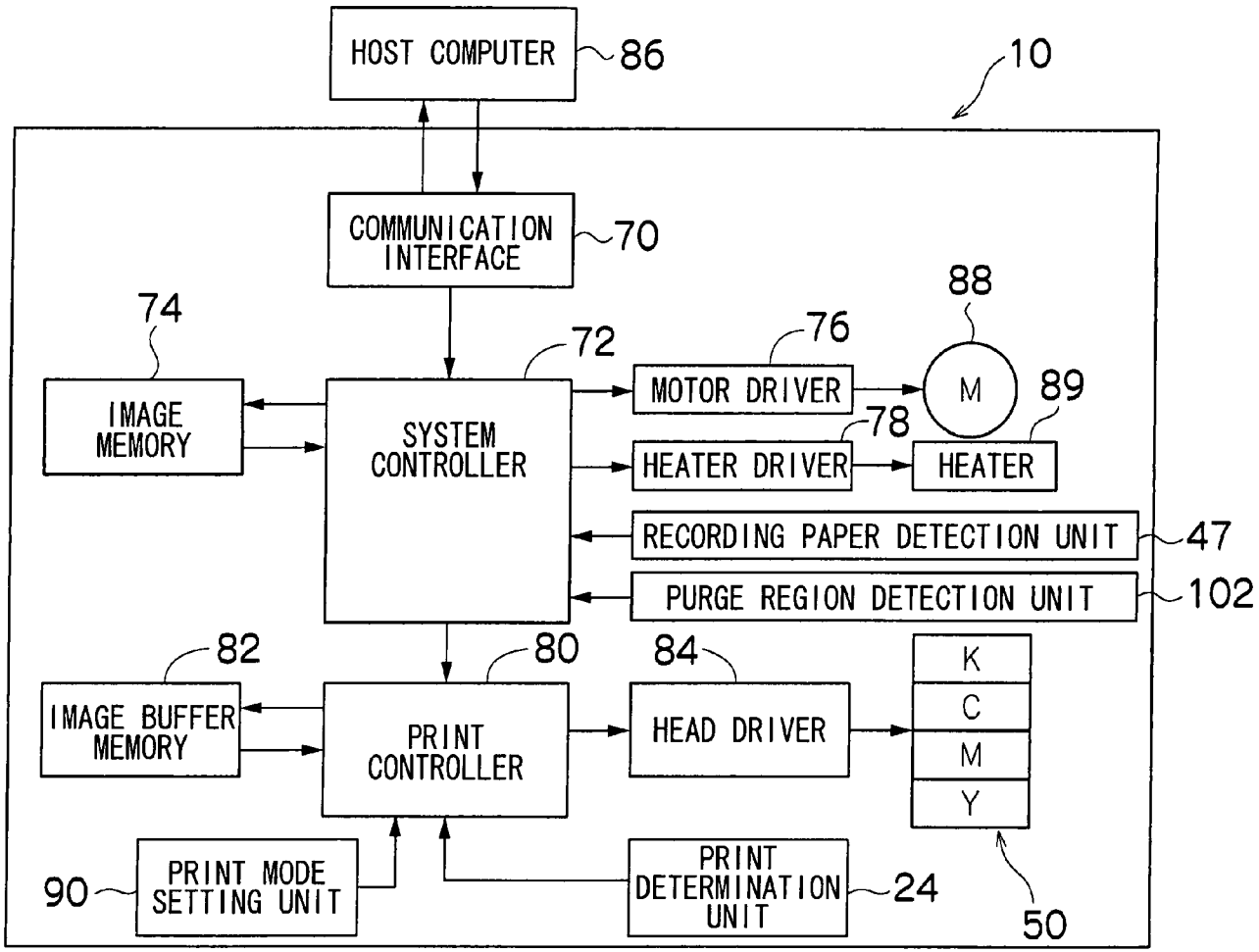
FIG. 5 is a block diagram of principal components showing a system configuration of the inkjet recording apparatus.

FIG. 5 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

Figure 7:
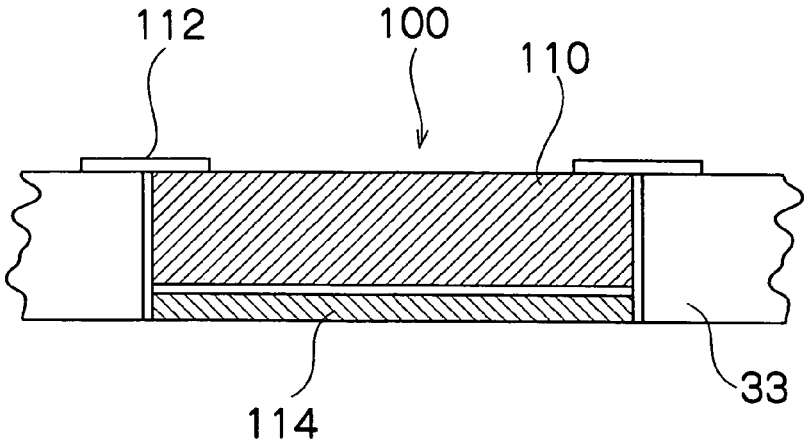
FIG. 7 is a drawing showing the detailed composition of an absorbing member.

The motor driver (drive circuit) 76 drives the motor 88 in accordance with commands from the system controller 72. The motor driver 76 and motor 88 alone are shown in FIG. 7, but the system controller 72 controls a plurality of motor drivers and motors.

The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the discharge timing and discharge amount of the ink-droplets from the print head 50 are controlled by the head driver 84 on the basis of the image data. Desired dot sizes and dot placement can be brought about thereby.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors on the basis of the print data received from the print controller 80. A feedback control system for keeping the drive conditions for the print heads constant may be included in the head driver 84.

The inkjet recording apparatus IO is provided with a print mode setting unit (discharge mode switching unit) 90, through which a high-speed mode (draft mode) and a high-resolution mode (recommended mode) can be set (i.e., the high-speed mode and the high-resolution mode are switchable). The print mode setting unit 90 outputs signals representing the set print mode to the print controller 80, which controls the discharge from the print head 50 through the head driver 84 according to the set print mode.

The print mode setting unit 90 may be composed of a switching member. Alternatively, the print mode setting unit 90 may have a construction in which the print mode is set by a software operated through a man-machine interface such as a keyboard and a touch-panel display. It is also possible that the host computer 86 sends the print data along with the print mode information to the inkjet recording apparatus 10.

The inkjet recording apparatus 10 is also provided with various sensors (detectors) at various parts, such as a sensor disposed on the paper conveyance path, and the like, for detecting the presence of the recording paper 16. The detection signals outputted from the various sensors are sent to the control part such as the system controller 72 through the corresponding interface circuits, and the processing and control are performed according to the detection signals.

The recording paper detection unit 47 shown in FIG. 1 and the purge region detection unit 102 are shown in FIG. 5 out of the above-described various sensors. The detection signals outputted from the recording paper detection unit 47 and the purge region detection unit 102 are sent to the system controller 72, and the controls such as the conveyance control (positional alignment) of the suction belt conveyance unit 22 and the discharge control (the purge control) are performed according to the detection signals.

Preliminary Discharge (Purge) Control

As described with reference to FIG. 4, the inkjet recording apparatus 10 carries out purging at periodic intervals with the object of removing ink of increased viscosity that has formed in the vicinity of the ink discharge holes of the respective nozzles. In purging, it is possible to cause the ink of increased viscosity to be discharged onto the cap 64 shown in FIG. 4, or it is possible for the ink of increased viscosity to be discharged onto the purge region 100 provided on the belt 33. Below, the purge control performed in the inkjet recording apparatus 10 is described.

Figure 6:
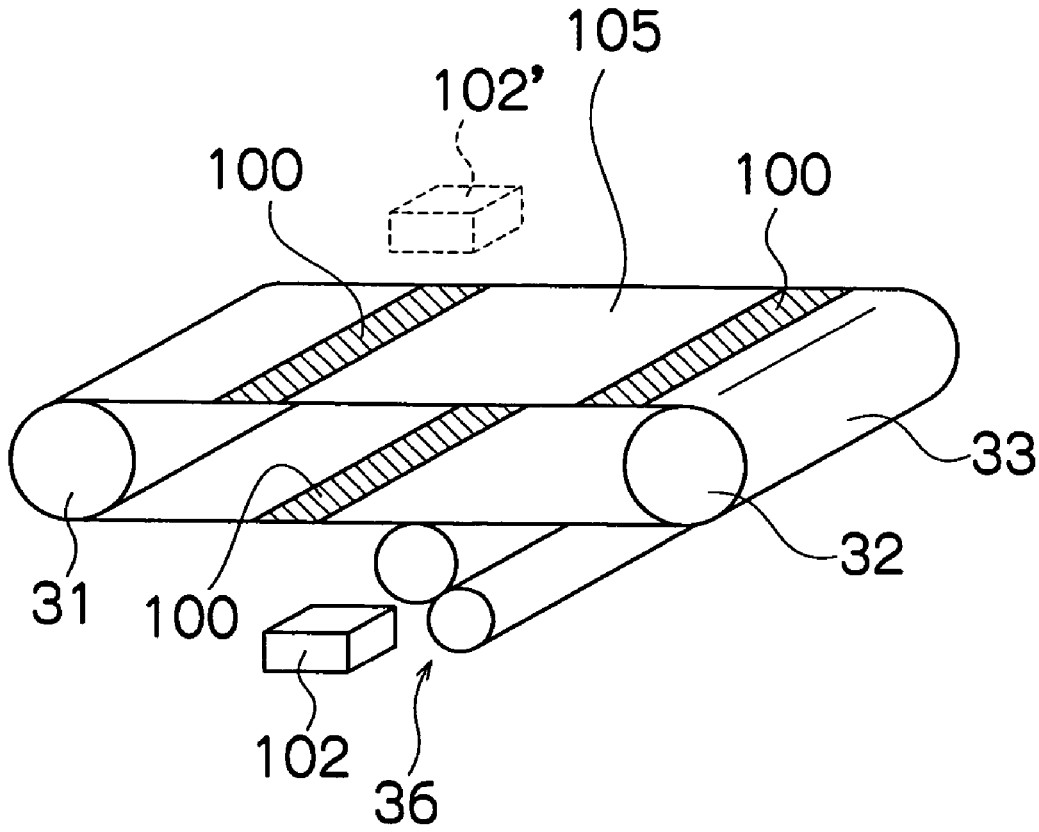
FIG. 6 is a drawing showing the detailed composition of the belt of an inkjet recording apparatus relating to the present embodiment.

FIG. 6 shows the details of the belt 33 illustrated in FIG. 1. On the belt 33, there are provided the purge regions 100 and the paper attraction regions 105 across the full width of the belt 33. The purge regions 100 have at least the length required for the droplets corresponding to one line to be deposited upon in the conveyance direction of the recording paper and are regions for receiving ink droplets during purging. The paper attraction regions 105 can hold the recording paper 16 by attraction. FIG. 6 shows a mode wherein each of the purge regions 100 and the paper attraction regions 105 is of the same width as the belt 33, but the width of the purge regions 100 and the paper attraction regions 105 may be smaller than that of the belt 33.

The interval between purge regions 100 (i.e., the length of the paper attraction region 105 along the paper conveyance direction) may be determined in accordance with the size of the recording paper 16. For example, it may be determined in accordance with the maximum size of the recording paper 16, or it may be determined in accordance with the most frequently used size of the recording paper 16. Moreover, it may also be determined in accordance with the lowest common multiple of the most frequently used size and the second most frequently used size, or alternatively, other modes may be adopted. Furthermore, it is possible for one sheet of recording paper 16 to be laid in this region, or for a plurality of sheets of recording paper 16 to be laid in same.

The purge region 100 is constituted by an absorbing member (numeral 110 in FIG. 7) which has high absorbency with respect to the liquid droplets, such as a non-woven cloth, or the like. The absorbing member used in the purge region 100 needs to use a material which does not expand, in order to ensure the conveyance characteristics of the belt 33 (the conveyance accuracy, conveyance speed, and the like). In order to ensure the prescribed strength and expansion characteristics, it is possible to reinforce the whole of the purge region 100, or the edge regions thereof, or the like.

For the region of the belt 33 outside the purge regions 100, a material such as polyimide, metal, resin, or the like, is used. The aspects to hold the recording paper 16 by attraction in the paper attraction regions 105 include the air suction where a plurality of suction apertures are formed on the paper attraction regions 105 and air is sucked up through the suction apertures a suction device such as a pump, and the electrostatic attraction to hold the recording paper 16 by the electrostatic attraction.

The purge region detection unit 102 including a purge region detection sensor is provided in order to detect the phase of the belt 33, and when a purge region 100 is detected by the purge region detection unit 102, a detection signal is sent to the system controller 72 illustrated in FIG. 5.

The purge region detection unit 102 may distinguish the purge region 100 from the other regions by means of the difference in the intensity of light reflected by the belt 33, or it may use a sensor based on another method. In order to make the detection by the purge region detection unit 102 easier to perform, the purge region 100 may be constituted in such a manner that it produces a large difference in reflectivity with respect to the other portions, and it is also possible to change the surface roughness whilst maintaining the same color type.

FIG. 6 shows a mode where one purge region detection unit 102 is provided, but it is also possible to provide a plurality of purge region detection units 102. Moreover, FIG. 6 shows a mode where the purge region detection unit 102 is arranged at the side opposite from the side of the suction belt conveyance unit 22 where the belt 33 receives the ink-droplets discharged from the print head 50, but it is also possible to arrange the purge region detection unit 102 at the position denoted by a reference numeral 102' as shown with the dashed lines in FIG. 6.

In the system controller 72, when a detection signal relating to detection of the purge region 100 is received in a purging operation during execution of a print operation, then ink or a processing liquid, or the like, is discharged from the respective discharge nozzles, onto the purge region 100. The ink, or the like, absorbed onto the absorbing member of the purge region 100 is removed by the belt cleaning unit 36 illustrated in FIG. 1. The belt cleaning unit 36 may adopt a mode using a cleaning roll having higher absorbency than the absorbing member, wherein the absorbed liquid is removed by means of the difference in absorbing capability between the absorbing member and the cleaning roll, or it may adopt a mode wherein the absorbed liquid is suctioned away by means of a pump.

Furthermore, a mode may also be adopted wherein the ink, or the like, is removed by suction, by means of the suction force of a suction chamber 34.

Moreover, a mode may also be adopted wherein cleaning is performed by means of a cleaning solution. In the present embodiment, a mode is described wherein the cleaning device for the belt 33 also serves as a cleaning device for the purge regions 100, but it is also possible to provide separate cleaning devices.

FIG. 7 is a drawing showing a cross-section of the absorbing member 110 used in the purge region 100. The absorbing member 110 is bonded to the belt 33 by means of an adhesive 112. Furthermore, in order to maintain the strength of the absorbing member 110, a metallic mesh 114 made of stainless steel, or the like, is provided on the under side of the absorbing member 110. The liquid retaining force of a filter is added to the liquid retaining force of the absorbing member 110 (for example, a non-woven cloth), thereby increasing the amount of ink that it can hold.

The absorbing member 110 can be cleaned by means of the belt cleaning device 36 shown in FIG. 1 (for example, a suction device, such as a pump, or the like).

It is also possible to use a sponge for the absorbing member 110, the pore diameter of the sponge being changed in a continuous fashion, in such a manner that the purged ink is absorbed rapidly into the interior of the sponge. If a composition of this kind is adopted, since the ink is absorbed rapidly into the absorbing member 110, there is no transfer of ink onto the rear of the recording paper 16, even if recording paper 16 is placed on the absorbing member 110.

Generally, a sponge has a large liquid retaining capacity compared to the amount of ink purged, and therefore the ink is not caused to leak from the sponge, even if it is bent by the belt 33.

Figure 8:
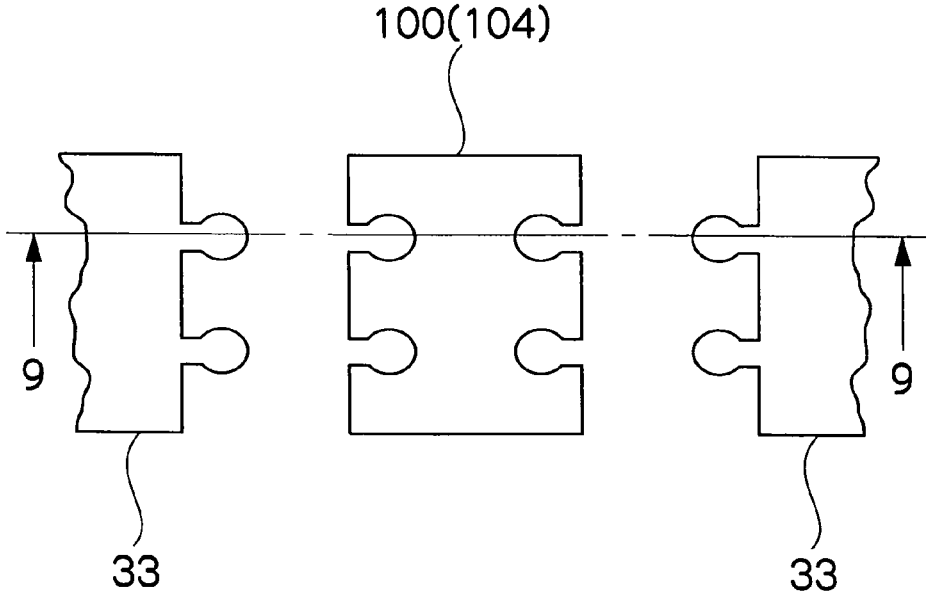
FIG. 8 is a drawing showing an example of the connection of the purge region to the belt shown in FIG. 6.
Figure 9:
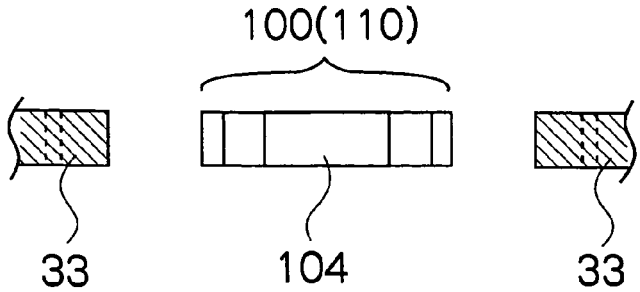
FIG. 9 is a cross-sectional view along view the line 9-9 in FIG. 8.

FIGS. 8 and 9 show examples of connections between the conveyance belt supporting body (core body) and an absorbing member 104, in a purge region 100. FIG. 8 is a drawing showing a side face of the belt 33 on which the recording paper 16, as viewed from the print head 50 side, and FIG. 9 is a cross-sectional view showing the three-dimensional composition of same (a cross-sectional view along the line 9-9 in FIG. 8).

If the absorbing member 104 which functions as the purge region 100 is simply bonded onto the supporting body of the belt 33, then a step difference will occur between the purge region 100 and the belt 33. Therefore, in the purge region 100, it becomes impossible to ensure the prescribed clearance with respect to the print head 50, and therefore it is necessary to control the phase of the belt 33 in such a manner that no recording paper 16 becomes placed on the purge region 100, which is not desirable. Moreover, if the absorbing member 104 swells due to the ink that it has absorbed, then it becomes impossible to ensure the prescribed clearance between the purge region 100 and the print head 50, and hence the distance between the purge region 100 and the print head 50 is determined by taking swelling of the purge region 100 into account.

On the other hand, in the interlock type connection shown in FIGS. 8 and 9 wherein the absorbing member 104 is fitted into the belt 33, it is possible to reduce the step difference between the belt 33 and the purge region 100 to a very small difference, and therefore, depending on the print mode (printing quality), it is possible to position the recording paper 16 on a purge region 100. Preferably, control is implemented in such a manner that the front end portion or the rear end portion of the recording paper 16 does not catch on the purge region 100. To cite one example of the step difference between the belt 33 and the purge region 100, a step difference of approximately 10-20 μm can be obtained.

For example, when in photograph quality (high quality) mode, the conveyance control device (the system controller 72) which controls the suction belt conveyance unit 22, performs control in such a manner that the recording paper 16 is not laid on the purge region 100 and the joint between the belt 33 and the purge region 100, and when in high speed (draft) mode, it performs control in such a manner that the recording paper 16 can be laid anywhere, regardless of the joint between the belt 33 and the purge region 100.

In other words, the system controller 72 shown in FIG. 5 functions as the determination device to determine whether it is acceptable or not to lay the recording paper 16 on the purge region 100, according to the print mode (discharge mode). Instead of the system controller 72, the print controller 80 may function as the determination device. Alternatively, in an embodiment where a single processor serves as both the system controller 72 and the print controller 80, the single processor may function as the determination device.

FIGS. 8 and 9 illustrate an interlocking type connection as one example of the connection between the belt 33 and the absorbing member 104, but the mode for connecting the belt 33 and the absorbing member 104 is not limited to this, and it should be ensured that the purge region 100 has a prescribed clearance with respect to the print head 50, and furthermore, the flatness of the belt 33 including the purge region 100 should be ensured in the printing region, at the least.

As shown in FIG. 8, preferably, the bonding strength can be increased if the connection portion between the belt 33 and the absorbing member 104 is made to be a mutually interlocking undulating shape.

Figure 10:
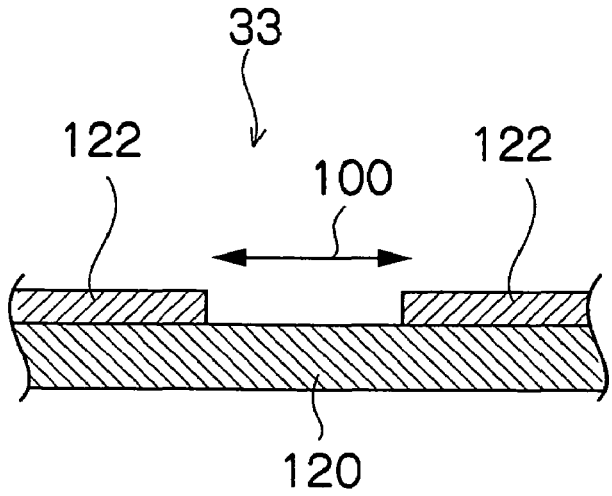
FIG. 10 is a drawing showing an application example of the purge region connection example illustrated in FIG. 8.

FIG. 10 shows a mode wherein an absorbing member is used in the supporting body 120 of the belt 33. A coating treatment suitable for conveying the recording paper 16 is provided in regions 122 apart from the purge region 100. In order to ensure the strength and expansion characteristics required in the belt 33, the supporting body 120 may be reinforced by using metal, resin, or the like. Furthermore, a laminated structure incorporating other members may also be used.

Next, the purge control performed in the inkjet recording apparatus 10 is described. As described above, in the inkjet recording apparatus 10, it is possible to implement purging by using the purge regions 100 of the belt 33 and the cap 64 as ink receptacles.

The timing at which purging is carried out is determined on the basis of the nozzle operation time, the number of droplets discharged, the time since the power was switched on, and the like, and purging is carried out periodically, at the prescribed timing, in accordance with the interval time between images, when printing a plurality of copies of the same image, or between different print data (namely, between print jobs). In the inkjet recording head 10, the purge regions 100 are used as ink receptacles in the case of purging carried out between images, during printing, while the cap 64 is used as an ink receptacle in the case of purging carried out when the head is not printing. By controlling purging in this manner, it is possible to reduce the wear on the purge regions 100 and the belt cleaning unit 36, and hence the lifespan of same can be increased.

More specifically, a purge execution command is issued by the system controller 72, and when the purge region 100 is detected by the purge region detection unit 102, a purge is carried out at the relevant nozzles, or at all of the nozzles. If the recording paper 16 is detected within the print region by a recording paper detection unit (not shown) that detects the presence of the recording paper 16 in the print region, then control may be performed in such a manner that purging is not carried out, or if the recording paper 16 has been detected in the print region, then control may be performed in such a manner that purging is carried out using the cap 64.

Preferably, a mode is adopted whereby the decision whether to use the purge region 100 or the cap 64 in the purging operation, can be controlled freely, by taking account of productivity, and other control factors.

If purging is carried out using the purge region 100, it is preferable to use cut paper as the recording paper 16. If roll paper is used, then the roll paper is cut by means of the cutter 28, before carrying out purging.

In the inkjet recording apparatus 10 having the composition described above, in purging executed between images, ink droplets are discharged onto the purge region 100 provided on the belt 33, and therefore, a recovery operation can be performed without lowering the print cycle. When ink is to be discharged onto the purge region 100, the purge region 100 is detected using the purge region detection unit 102, and the phase is aligned with that of the recording paper 16.

Moreover, if purging is carried out in the interval time between different print data, and not only between images, then purging can be carried out using the purge region 100.

On the other hand, in purging carried out when the power supply is switched on or when the nozzles are cleaned, control is performed whereby ink droplets are discharged onto the cap 64. The control is thus implemented whereby, as far as possible, if purging can be carried out using the cap 64, then purging is not carried out using the purge regions 100, and hence the lifespan of the purge regions 100 and the belt cleaning unit 36 can be increased.

When the belt 33 and the purge regions 100 are connected together, preferably they are connected in a manner that does not produce a step difference. Furthermore, a composition is also adopted whereby, even if the absorbing member (for example, numeral 104) of the purge region 100 swells up due to absorbing ink, then the distance between the purge region 100 and the print head 50 still maintains the prescribed clearance.

In the present embodiment, a mode was described wherein a belt 33 corresponding to the width of the recording paper 16 (in a direction substantially orthogonal to the conveyance direction) is used, but the belt 33 may also be divided in the width direction of the recording paper 16, and it may be constituted by a plurality of belts.

Figure 11:
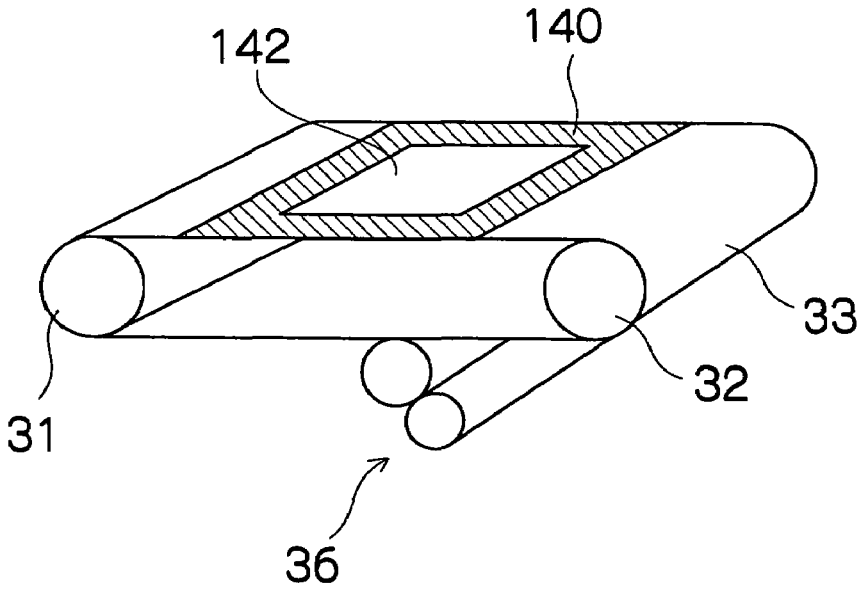
FIG. 11 is a drawing showing a modification example of the belt illustrated in FIG. 6.

Next, a modification example of the purge region 100 is described with reference to FIG. 11. In FIG. 11, items which are the same as or similar to those in FIG. 6 are labeled with the same reference numerals and description thereof is omitted here.

In FIG. 11, a mode is illustrated wherein the surplus ink receiving region 140 used when printing a full surface image (marginless image) and the purge region 100 shown in FIG. 6 constitute a shared region.

The surplus ink receiving region 140 is formed in such a manner that it surrounds a paper holding region 142 where the recording paper 16 is held on the belt 33. Moreover, the surplus ink receiving region 140 is constituted by an absorbing member having similar absorbing properties to the purge region 100 shown in FIG. 6.

In the modification example shown in FIG. 11, since the front edge portion and the trailing edge portion of the recording paper 16 are mounted on the surplus ink receiving region 140, then it is not possible to suction the front edge portion or the trailing edge portion of the recording paper 16. Consequently, when positioning the recording paper 16, it is necessary to carry out processing for removing curl from the front edge portion and the trailing edge portion of the recording paper 16, or to use paper that does not curl for the recording paper 16.

In the modification example described above, since the perimeter of the recording paper 16 is surrounded by the surplus ink receiving region 140, it is possible to prevent ink transfer onto the rear face of the paper, even when printing full surface images. The paper holding region 142 may be of the same size as the recording paper 16, or it may be smaller than the recording paper 16. If the paper holding region 142 is made smaller than the recording paper 16, then it must be constituted in such a manner that it holds the recording paper 16 in a reliable fashion.

In the purge regions 100 shown in FIG. 6, another modification example may be conceived wherein the surplus ink on the absorbing member 110 is sucked up by a suction device, such as a pump, or the like, provided on the inner side of the belt 33.

Figure 12:
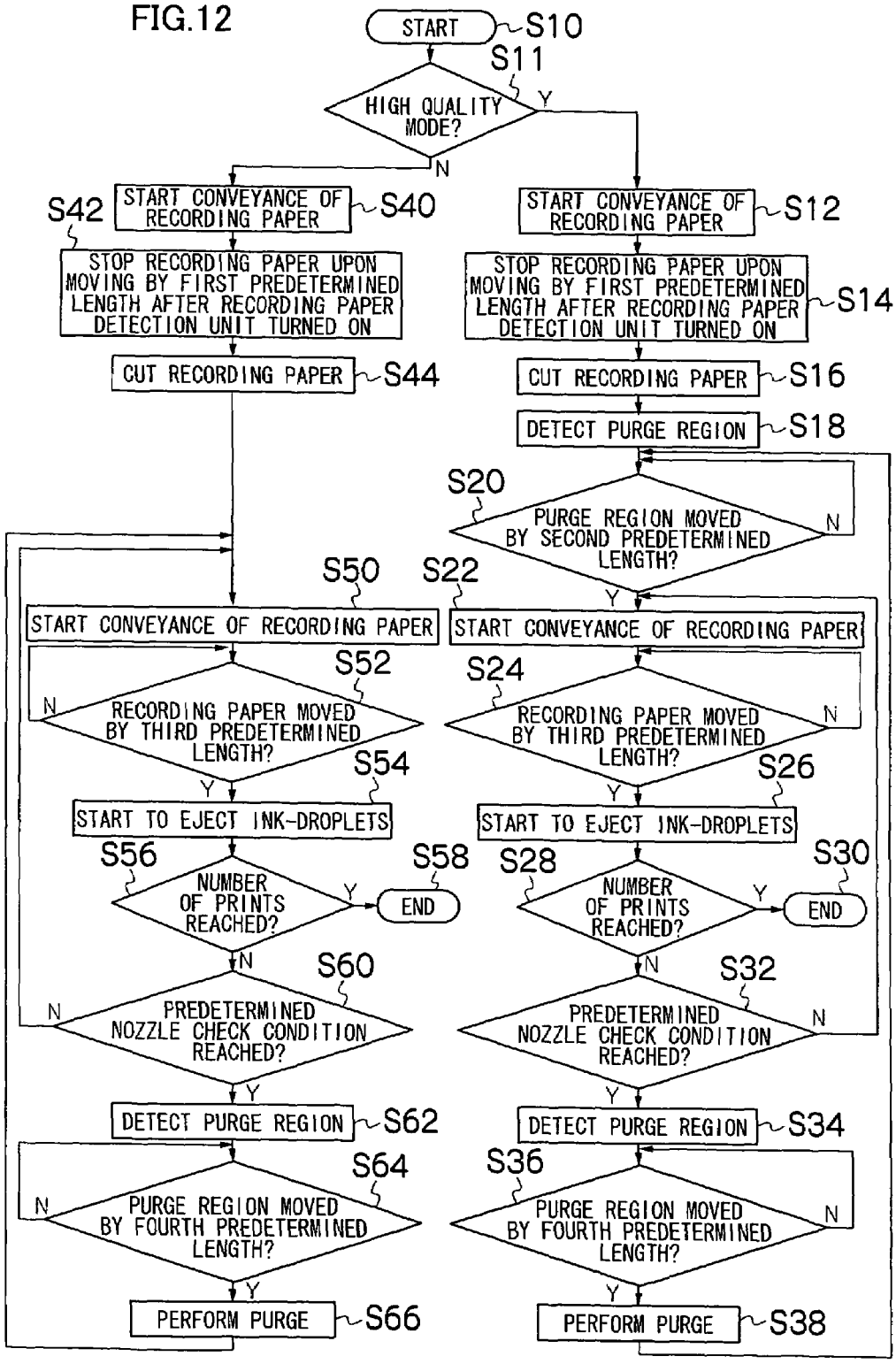
FIG. 12 is a flowchart showing the sequence of preliminary discharge control and print control in the inkjet recording apparatus.

FIG. 12 is a flowchart showing the sequence of preliminary discharge control and print control in the inkjet recording apparatus 10.

When printing is started (step S10), it is determined whether the print mode is the high quality mode or the high speed mode (step S11). If the print mode is the high quality mode (a YES determination), the recording paper 16 is supplied just before the suction belt conveyance unit 22 (step S12), and after the recording paper detection unit 47 shown in FIG. 1 is turned on (i.e., detecting the recording paper 16), the recording paper 16 is conveyed by a first predetermined length, which is equal to the distance between the detection region of the recording paper detection unit 47 and the standby position 49, and is stopped (step S14).

If the roll paper is used, the continuous paper is cut to the predetermined size while the recording paper 16 is conveyed by the first predetermined length (step S16). If the cut paper is used, the step S16 is not required.

In the suction belt conveyance unit 22, the purge region detection unit 102 shown in FIGS. 5 and 6 performs detection of the purge region 100 (step S18). After the purge region 100 is detected, it is determined whether the purge region 100 (the belt 33) has moved by a second predetermined length (step S20). The second predetermined length is the movement length to move the purge region 100 (i.e., to control the phase of the purge region 100) in order to prevent the recording paper 16 from being laid on the purge region 100.

If the movement length of the purge region 100 has not reached the second predetermined length at the step S20 (a NO determination), the movement of the suction belt conveyance unit 22 (the belt 33 and the purge region 100) is continued. If the movement length of the purge region 100 has reached the second predetermined length at the step S20 (a YES determination), the suction belt conveyance unit 22 is stopped in the state where the leading end of the paper attraction region 105 excluding the purge region 100 along the paper conveyance direction coincide with the leading end of the recording paper 16 that is standing by at the standby position 49 shown in FIG. 1, and the suction belt conveyance unit 22 starts to convey the recording paper 16 (step S22). The positional alignment of the recording paper 16 and the phase alignment of the suction belt conveyance unit 22 are thus performed (the phase is controlled) so that the recording paper 16 is not laid on the purge region 100 and the joint of the purge region 100.

After the conveyance of the recording paper 16 is started, it is determined whether the recording paper 16 (the belt 33) has moved by a third predetermined length (step S24). If the movement of the recording paper 16 has not reached the third predetermined length at the step S24 (a NO determination), the conveyance of the recording paper 16 is continued. If the movement of the recording paper 16 has reached the third predetermined length at the step S24 (a YES determination), the recording head 50 (the recording head 12K, at first) starts to eject ink-droplets to form the desired image on the recording paper 16 (step S26).

During the printing, the number of the prints are counted (step S28). When the number of the prints reaches a predetermined number (a set number of prints) at the step S28 (a YES determination), the print is finished and the print control is ended (step S30).

On the other hand, if the number of the prints has not reached the predetermined number at the step S28 (a NO determination), it is determined whether the operational history of each nozzle has reached a predetermined nozzle check condition (step S32).

In the present embodiment, a non-operational time period of each nozzle is used as the nozzle check condition. The critical non-operational time period is set for each nozzle according to the type of the ink used, the temperature in the print head 50, the temperature in the vicinity of the print head 50, and the like. It is possible to construct a database of the critical non-operational time period beforehand and to store the database in a predetermined storage unit (e.g., the image memory 74 shown in FIG. 5), so that the critical non-operational time is read from the database according to the type of the ink and the temperature of the print head 50.

At the step S32, it is determined whether the non-operational time period of each nozzle has reached the critical non-operational time period. If the non-operational time period of each nozzle has not reached the critical non-operational time period at the step S32 (a NO determination), the procedure advances to the step S22. If the non-operational time period of each nozzle has reached the critical non-operational time period at the step S32 (a YES determination), the procedure advances to the step S34.

At the step S34, the detection of the purge region 100 is performed. After the purge region detection unit 102 detects the purge region 100, it is determined whether the purge region 100 has moved by a fourth predetermined length (step S36). The fourth predetermined length is equal to the distance between the detection region of the purge region detection unit 102 and the printing region of the print head 12K. If the movement length of the purge region 100 has not reached the fourth predetermined length at the step S36 (a NO determination), the movement of the purge region 100 is continued. If the movement length of the purge region 100 has reached the fourth predetermined length at the step S36 (a YES determination), the purge is performed (step S38), and the procedure advances to the step S20.

On the other hand, if the print mode is the high speed mode at the step S11 (a NO determination), the procedure of steps S40 through S66, which correspond to the steps S12 through S38 excluding the steps S18 and S20 concerning the detection of the movement of the purge region 100 by the second predetermined length, is performed. In other words, if the print mode is the high speed mode, the recording paper 16 is laid on the suction belt conveyance unit 22 without the phase alignment of the suction belt conveyance unit 22 (i.e., irrespective of the phase of the suction belt conveyance unit 22).

More specifically, after the leading end of the recording paper 16 is stopped at the standby position 49 set before the entrance of the suction belt conveyance unit 22 at the step S42, the detection of the purge region 100 and the phase alignment of the suction belt conveyance unit 22 corresponding to the steps S18 and S20 are not performed, and the procedure advances to the step S50, where the recording paper 16 is laid on the suction belt conveyance unit 22 and the conveyance of the recording paper 16 is started. If the roll paper is used, the continuous paper is cut to the predetermined size (step S44) after the recording paper 16 is stopped at the standby position 49 at the step S42, and the procedure advances to the step S50.

The movement lengths of the conveyance rollers 48, the suction belt conveyance unit 22, and the like, compared with the above-described first, second, third and fourth predetermined lengths can be calculated from the control signal (the drive signal) applied to the motor driving the conveyance rollers 48 and the suction belt conveyance unit 22. Alternatively, another construction is possible where a position (phase) determination device such as a linear encoder, which outputs signals (e.g., pulse signals) corresponding to the movement (moving speed) of the belt 33, is arranged at the belt 33, and the movement lengths of the conveyance rollers 48, the suction belt conveyance unit 22, and the like, compared with the first through fourth predetermined lengths are calculated from the signals outputted from the determination device. Instead of the linear encoder arranged at the belt 33, an encoder can be arranged at the motor driving the belt 33.

The first through fourth predetermined lengths can be set as the movement lengths of the belt 33, the purge region 100 and the recording paper 16. Alternatively, the first through fourth predetermined lengths can be set as the movement time periods of the belt 33, the purge region 100 and the recording paper 16.

The actual movement lengths (or movement time periods) of the conveyance rollers 48, the belt 33, the purge region 100 and the recording paper 16 compared with the first through fourth predetermined lengths are calculated by the system controller 72 shown in FIG. 5. It is preferable to provide the system controller 72 with a system parameter storing unit to store the first through fourth predetermined lengths as system parameters.

In the present embodiments, an inkjet recording apparatus provided with a full line type print head was described, but the scope of the present invention is not limited to this, and hence it may also be applied to a shuttle scanning type print head.

Furthermore, in the present embodiments, a piezo method using a piezoelectric element in order to discharge ink droplets was described, but the present invention may also be applied to a thermal type inkjet recording apparatus, wherein an energy generating body is provided in an ink chamber, and ink is discharged by means of a bubble generated by heating the ink inside the pressure chamber, by means of the energy generating body.

The scope of application of the present invention is not limited to an inkjet recording apparatus, and it may also be applied to a liquid discharging apparatus for discharging a liquid, such as water, a chemical, processing liquid, or the like, from discharge holes (nozzles).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet discharging apparatus, comprising:

a discharging head which has discharge holes for discharging liquid droplets;

a conveyance device which conveys at least one of the discharging head and discharge receiving media in a direction substantially orthogonal to a width direction of the discharge receiving media to cause the discharging head and the discharge receiving media to move relative to each other;

a belt which holds the discharge receiving media in a discharge region opposing a face of the discharging head whereon the discharge holes are formed, the belt having a purge region comprising an absorbing member which receives and absorbs the liquid droplets discharged from the discharging head during preliminary discharge; and a positional alignment device which aligns a position of the purge region in such a manner that the purge region is positioned between the discharge receiving media, wherein the absorbing member comprises a material that has high absorbency with respect to the liquid droplets, and the liquid droplets are discharged directly onto an upper surface of said material that has high absorbency with respect to the liquid droplets and absorbed therein.

2. The droplet discharging apparatus as defined in claim 1, wherein the absorbing member for absorbing the droplets composes a supporting body of the belt.

3. The droplet discharging apparatus as defined in claim 1, wherein the belt has a plurality of the purge regions, and the plurality of purge regions are disposed at intervals corresponding to a most frequently used size of the discharge receiving medium.

4. The droplet discharging apparatus as defined in claim 1, wherein a clearance between a face of the purge region opposing the face of the discharging head whereon the discharge holes are formed, and the face of the discharging head is within a clearance range between a discharge receiving medium holding face of the belt and the face of the discharging head.

5. The droplet discharging apparatus as defined in claim 1, further comprising a purge region cleaning device which cleans the purge region.

6. The droplet discharging apparatus as defined in claim 1, further comprising:

a maintenance member; and a discharge control device which performs control in such a manner that preliminary discharge is carried out onto the maintenance member during a non-discharging period.

7. The droplet discharging apparatus as defined in claim 1, further comprising:

a discharge mode switching device which switches discharge modes; and a judging unit which judges whether or not to position the recording medium on the purge region in accordance with the discharge mode, wherein the positional alignment device aligns the position of the purge region in accordance with a judgment result by the judging unit.

8. An image forming apparatus, comprising:

a recording head which has discharge holes for discharging ink droplets;

a conveyance device which conveys at least one of the recording head and recording media in a direction substantially orthogonal to a width direction of the recording media to cause the recording head and the recording media to move relative to each other;

a belt which holds the recording media in a recording region opposing a face of the recording head whereon the discharge holes are formed, the belt having a purge region comprising an absorbing member which receives and absorbs the ink droplets discharged from the recording head during preliminary discharge; and a positional alignment device which aligns a position of the purge region in such a manner that the purge region is positioned between the recording media, wherein the absorbing member comprises a material that has high absorbency with respect to the liquid droplets, and the liquid droplets are discharged directly onto an upper surface of said material that has high absorbency with respect to the liquid droplets and absorbed therein.

9. The image forming apparatus as defined in claim 8, wherein the purge region is also used as a surplus ink receiving region in a case of marginless printing.

10. A preliminary discharge method for a droplet discharging apparatus comprising: a discharging head which has discharge holes for discharging liquid droplets; a conveyance device which conveys at least one of the discharging head and discharge receiving media in a direction substantially orthogonal to a width direction of the discharge receiving media to cause the discharging head and the discharge receiving media to move relative to each other; a belt which holds the discharge receiving media in a discharge region opposing a face of the discharging head whereon the discharge holes are formed, the belt having a purge region comprising an absorbing member which receives and absorbs the liquid droplets discharged from the discharging head during preliminary discharge, the method comprising:

a moving step of causing the discharging head and the discharge receiving media to move relative to each other;

a purge region detecting step of detecting the purge region provided on the belt holding the discharge receiving media;

a preliminary discharge step of performing a preliminary discharge onto the purge region, when the purge region is detected by the purge region detecting step; and an absorbing step of causing the absorbing member of the purge region to absorb the liquid droplets discharged from the discharging head, wherein the absorbing member comprises a material that has high absorbency with respect to the liquid droplets, and the liquid droplets are discharged directly onto an upper surface of said material that has high absorbency with respect to the liquid droplets and absorbed therein.

11. The droplet discharging apparatus as defined in claim 1, wherein the belt has a plurality of purge regions disposed at intervals along said belt, and each purge region comprises an absorbing member which receives and absorbs the liquid droplets discharged from the discharging head during preliminary discharge; and the positional alignment device aligns a position of the plurality of purge regions with respect to the discharge receiving media in such a manner that a different one of the plurality of purge regions is positioned on either side of the discharge receiving media in the direction of conveyance.

12. The image forming apparatus as defined in claim 8, wherein the belt has a plurality of purge regions disposed at intervals along said belt, and each purge region comprises an absorbing member which receives and absorbs the liquid droplets discharged from the discharging head during preliminary discharge; and the positional alignment device aligns a position of the plurality of purge regions with respect to the discharge receiving media in such a manner that a different one of the plurality of purge regions is positioned on either side of the discharge receiving media in the direction of conveyance.

13. The preliminary discharge method for a droplet discharging apparatus as defined in claim 10, wherein the belt has a plurality of purge regions disposed at intervals along said belt, and each purge region comprises an absorbing member which receives and absorbs the liquid droplets discharged from the discharging head during preliminary discharge; and the positional alignment device aligns a position of the plurality of purge regions with respect to the discharge receiving media in such a manner that a different one of the plurality of purge regions is positioned on either side of the discharge receiving media in the direction of conveyance.

14. The droplet discharging apparatus as defined in claim 1, wherein the purge region is positioned between the discharge receiving media, and no portion of the discharge receiving media overlaps the purge region in a direction normal to a face of the belt.

15. The image forming apparatus as defined in claim 8, wherein the purge region is positioned between the discharge receiving media, and no portion of the discharge receiving media overlaps the purge region in a direction normal to a face of the belt.

16. The preliminary discharge method for a droplet discharging apparatus as defined in claim 10, wherein the purge region is positioned between the discharge receiving media, and no portion of the discharge receiving media overlaps the purge region in a direction normal to a face of the belt.

* * * * *